US007648201B2

(12) United States Patent
Eysing

(10) Patent No.: US 7,648,201 B2
(45) Date of Patent: Jan. 19, 2010

(54) SUPPORT ELEMENT

(76) Inventor: Volker Wilhelm Eysing, Boninstrasse 52, Kiel (DE)

( * ) Notice: Subject to any disclaimer, the term of this patent is extended or adjusted under 35 U.S.C. 154(b) by 218 days.

(21) Appl. No.: 11/349,282

(22) Filed: Feb. 8, 2006

(65) Prior Publication Data

US 2006/0181126 A1 Aug. 17, 2006

(30) Foreign Application Priority Data

Feb. 16, 2005 (CH) ..... 0277/05

(51) Int. Cl.
*A47C 7/02* (2006.01)

(52) U.S. Cl. ..... 297/284.3; 297/452.63

(58) Field of Classification Search ..... 297/284.3, 297/284.1, 452.63, 284.2; 248/560
See application file for complete search history.

(56) References Cited

U.S. PATENT DOCUMENTS

| | | | | |
|---|---|---|---|---|
| 4,585,272 | A * | 4/1986 | Ballarini | 297/284.3 |
| 5,320,410 | A * | 6/1994 | Faiks et al. | 297/296 |
| 5,328,245 | A * | 7/1994 | Marks et al. | 297/284.3 |
| 6,986,549 | B2 | 1/2006 | Kniese | |
| 7,320,503 | B2 * | 1/2008 | Eysing | 297/452.63 |

FOREIGN PATENT DOCUMENTS

| | | |
|---|---|---|
| DE | 19916411 | 4/1999 |
| EP | 1 040 999 | 10/2000 |

* cited by examiner

*Primary Examiner*—Milton Nelson, Jr.
(74) *Attorney, Agent, or Firm*—Nixon & Vanderhye P.C.

(57) ABSTRACT

The invention relates to a support element (11) for the human body, in particular to a backrest, of a chair or armchair.

The support element (11) has a support face (21) that forms a front side of the support element. The support element is equipped with a self-adapting longitudinal structure (13), which includes at least one front, first longitudinal element (15), and at least one rear, second longitudinal element (17), extending parallel to the first longitudinal element (15), as well as a plurality of spacers (19), which are each pivotably connected to the first longitudinal element (15) and to the second longitudinal element (17). The second longitudinal element (17) is connected at a rigid angle to the first longitudinal element (15) at at least one connection point (27) and is borne at a support point (29) spaced apart from the connection point (27). The spacers (19) keep the second longitudinal element (17) spaced apart from the first longitudinal element (15) between the connection point (27) and the support point (29). Bearer means (15, 37) are present, for instance two elongated peripheral parts (15), which extend in the same direction as the longitudinal elements (15, 17), and/or a plurality of riblike members (37).

20 Claims, 10 Drawing Sheets

SUPPORT ELEMENT

This application is a new U.S. patent application claiming priority to CH 00277/05 filed 16 Feb. 2005, the entire contents of which are hereby incorporated by reference.

The invention relates to a support element for the human body, in particular to a backrest, of a chair or armchair.

TECHNICAL FIELD

From the disclosure in European Patent Disclosure EP-A 1040999, which is based on German Patent Disclosure DE-A 199 16 411, a structural part for receiving forces is known, which structural part has one dull end and one sharp end in the longitudinal direction and has a flexible outer skin, which covers the structural part on two sides from the dull end to the sharp end. The structural part is meant to be secured to the dull end, while the sharp end is meant to project freely into the open. On the underside and on the top of the structural part, the outer skin forms a cohesive, one-piece unit. The underside and the top are joined together by stretchers. Connecting means to the stretchers are embodied on the inside of the outer skin. In these connecting means, the stretchers are hinged. Thanks to the parallel-oriented stretchers, the flexible and dimensionally stable outer skin is kept to a deformable profile. This structure of the structural part assures that it deflects counter to a force acting on the outer skin. In this reference, it is suggested that such a structural part could be constructed in backrests or seat faces of chairs. By connecting two frameworks (the term "framework" is presumed to mean such a structural part), whose dull ends are joined together via an axial shaft, a chair is created which is capable of holding a person and adapting to the anatomy of that person. In FIG. 20, which is the only figure to show a chair, a seat cushion and a backrest are shown which are both identified with the reference numeral for a structural part. These two structural parts are pivotably connected about a common axis and appear to be held together elastically in a relative position with a spring.

BACKGROUND

This chair concept has been refined in US Patent Disclosure US-A 2004/0183348. This reference discloses a support element, corresponding to the structural part described above, which has a skeleton that has a skin to which a plurality of ribs are pivotably connected. The skin forms a flexible load-bearing face for supporting a seating force that is exerted on the skin by a body. The skeleton works together in such a way that it is at least partly deformed by the seating force counter to the direction of the seating force. The skeleton furthermore has at least one spring element, which joins the skin and/or ribs together, or the skin in one piece forms a backrest and a seat face. The spring force of the spring element in particular brings about an adaptation of the shape of the support element. For this purpose, the spring element is located in a diagonal of the rectangle that is defined by two ribs and the skin located at two ends of the ribs.

Such chair backrests have the advantage that the backrest adapts to the form of the thoracic spine with a concave deformation and at the same time supports the thoracic spine at every point. The adaptation in the concave region of the backrest takes place because of the shape of the back being braced and because of the forces exerted by it on the backrest.

A disadvantage of these chair backrests, however, is that the chair backrest has vertical sections that remain the same over its entire width.

It is therefore the object of the invention to create a support element which is equipped with a support structure that optimally conforms to the body in response to the shape of the body and to pressure forces exerted on the support element by the body being braced and supports the body. The support face, in a preferred embodiment of the invention, should also be adapted to the shape of the back transversely to the length of the spinal column and of the support element as well.

SUMMARY

This object is attained according to the invention by a support element as defined by claim 1.

In this support element, a support face forms a front side of the support element. A body being braced therefore leans from the front against the support face. The support element of the invention has a self-adapting longitudinal structure. The self-adapting longitudinal structure has a first longitudinal element on the front, with rib shaped members, or two first longitudinal elements, located for instance on rib shaped members, and at least one second, rear longitudinal element, which are joined together pivotably or flexibly via spacers and are joined together at a rigid angle at at least one point and at a second point have a support point, on which a support can be disposed.

Between these first longitudinal elements, or the ends of the rib shaped members, the support face is formed or braced by a transverse element. At least one second rear longitudinal element, extending parallel to the first longitudinal element, is joined rigidly at a support point to the first longitudinal element or to the first longitudinal elements. The second longitudinal element is borne at a support point which is spaced apart from the connection point in the longitudinal direction of the longitudinal elements. Between the support point and the connection point, a plurality of spacers keep the second longitudinal element spaced apart from the first longitudinal elements. These spacers are each joined pivotably to at least one of the first longitudinal elements and to the at least one second longitudinal element.

Advantageously, the second longitudinal element is joined at a rigid angle to the first longitudinal element at two connection points spaced apart from one another in their longitudinal direction. The support point is expediently embodied between the two connection points. The result is a mechanism acting beyond the support point, between the first and second longitudinal elements. Beyond the support point, which is advantageously located in the lumbar region of the person's back being braced, this mechanism adapts to the shape of the thoracic spine being braced and braces the lumbar spine as well, and last but not least, it also braces the pelvic brim by conforming to it. If a person leans back in the region of the thoracic spine, increased pressure is exerted against the pelvic brim.

The support point in a backrest is advantageously embodied to one side of a center between the two connection points. It is preferably located in the region of the lumbar spine.

A support is located at the support point. This support braces the support element and joins it for instance to the frame of a chair. This support can be joined, for instance in a cushioned way, pivotably to the second longitudinal element. However, preferably it is fixed in its position relative to the second longitudinal element and is accordingly nonpivotably located on the second longitudinal element. The adaptation of such a backrest takes place primarily by way of the change in shape of the longitudinal structure, formed of the first longitudinal element, the second longitudinal element, and spacers. An adaptation by changing the inclination of the support element overall can be provided in addition.

The transverse elements are preferably pivotably connected to the longitudinal structures. Such transverse elements can conform to the shape of the person's back by rotating at the pivotable connection points, if the pivot axis of this pivotable connection between the transverse element and the longitudinal structures is approximately perpendicular to the length of the longitudinal structures.

The spacers may be hoops, which are connected in a hinged fashion to the first and second longitudinal elements. If a second longitudinal element is provided, which extends centrally relative to the support element and is joined to peripheral first longitudinal elements, then the spacers also span the spacing between the first and the second longitudinal element in the direction crosswise to the length of the longitudinal structures.

The transverse elements are preferably pivotably connected to the longitudinal structures. Such transverse elements can conform to the shape of the person's back by rotating at the pivotable connection points, if the pivot axis of this pivotable connection between the transverse element and the longitudinal structures is approximately perpendicular to the length of the longitudinal structures.

The pivot axis of the pivotable connection between the transverse elements and the longitudinal structures is preferably located in front of a support structure formed by the transverse elements. As a result, with the pressure of the body being supported on a transverse element, the transverse element is automatically aligned with the surface of the body being supported.

In the direction in which the transverse elements extend, these transverse elements are preferably shaped in a way adapted to the shape of the body that is to be supported. This anatomical shaping of the transverse elements optionally includes a general concave curvature in this region, a recess for a backbone, a transverse curvature, which depending on the location of the transverse element is slightly convex in the region of the lumbar support and slightly concave in the region of the thoracic spine.

The longitudinal structures are also expediently shaped in a way adapted to the shape of the body that is to be supported. Accordingly, they have a predetermined shape, which is designed to match the S-curve of the spine, for instance.

The support element is expediently held and braced on the second longitudinal element. As a result, the support secured to the second longitudinal element does not hinder the function of the longitudinal structures that are joined by the spacers.

Since the second longitudinal element absorbs pressure forces and the first longitudinal elements essentially absorb tensile forces, the second longitudinal element is embodied as more rigid than the first longitudinal element. The rigidity of the second longitudinal element is adaptable, in an advantageous embodiment of the invention. The adaptation is done for instance by the insertion of rods or strips in the longitudinal direction of the longitudinal element that stiffen the second longitudinal element. To increase its rigidity, the second longitudinal element may be embodied in two layers.

The second longitudinal element may be located centrally, in particular between the two first longitudinal elements. This makes it possible to provide only a single second longitudinal element.

However, two second longitudinal elements may also be present. They may be provided side by side, centrally, between the first longitudinal elements at the front. They may also be equally well embodied peripherally like the first longitudinal elements, in the immediate vicinity of those.

The support element is preferably braced on the second longitudinal element. The bracing is therefore expediently done centrally, for a centrally located second longitudinal element, but peripherally in the case of two peripheral second longitudinal elements.

DETAILED DESCRIPTION

Figure 1:
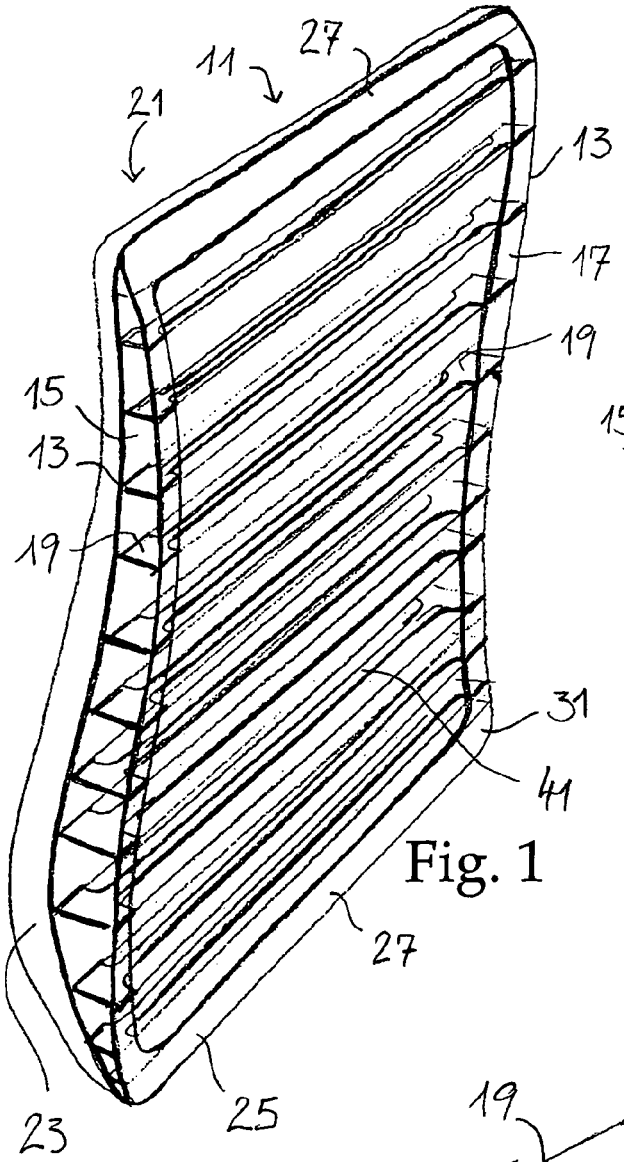
FIG. 1 shows a sketch in perspective of a backrest of the invention.
Figure 2:
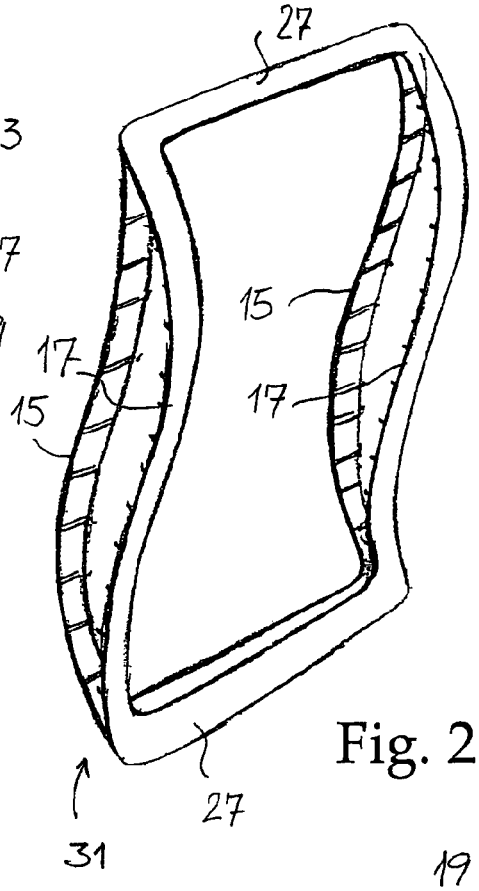
FIG. 2 shows a sketch in perspective of the backrest without its transverse elements and spacers.

In each of the exemplary embodiments, backrests 11 of a chair are shown. Although such backrests 11 also represent the most important application of support elements 11 according to the invention, still other support elements 11 are not meant to be excluded.

In the exemplary embodiments, self-adapting longitudinal structures 13 which have the desired kinematics are provided.

These longitudinal structures 13 have a front tension element 15 and a rear compression element 17, which are joined together via spacers 19.

The front of the support element 11 in each case is formed by a support face 21. This support face 21 is shown only in FIGS. 1, 12, and 13. This support face 21 is the front of a thin pad 23 in front of a skeleton shaped support structure 25. This skeleton shaped support structure 25 has at least one self-adapting longitudinal structure 13, which is capable of adapting to a person's back or some other body part that is being supported. This longitudinal structure 13 includes one or two first longitudinal elements 15 on the front and one or two second longitudinal elements 17 at the rear, extending parallel to the first longitudinal element 15. Theoretically, more than two of these longitudinal elements 15 may be present on the front or at the rear, but the desired adaptability of the support element 11 can be achieved with one or preferably such first longitudinal elements 15 and at least one second longitudinal element 17. The second longitudinal element 17 is rigidly joined to the first longitudinal element 15 at one or two connection points 27. In other words, the angles at which the two longitudinal elements 15, 17 meet remain constant, regardless of the deformation of the longitudinal structure 13. The longitudinal structure 13 is borne at a support point 29 (not shown in FIGS. 1 through 9) that is spaced apart from the connection point. A plurality of spacers 19, which keep the second longitudinal element 17 spaced apart from the first longitudinal element 15 between the connection point 27 and the support point 29, are each joined elastically or pivotably to the first longitudinal element 15 and likewise elastically or pivotably to the second longitudinal element 17. A longitudinal structure 13 of this kind may have one connection point 27 on one end, as in FIG. 10 or FIG. 11, or one connection point 27 on each of two ends, as in the other drawings.

Two elongated peripheral parts (in the drawings, these are always identical to the front longitudinal element 15), which extend in the same direction as the longitudinal elements 15,17, or a series of rib shaped members 37 extending horizontally as far as the periphery of the support element 11, are braced on the self-adapting longitudinal structure 13. They take on its motions and carry at least one transverse element 39 that forms or braces the support face. This transverse element extends from one edge of the support element 11 to the other and is secured to the peripheral parts 15 or rib shaped members 37. Instead of a single, flexible transverse element 37, a plurality of flexibly borne transverse elements 37 independent of one another may form or brace the support face 21. A single transverse element could for instance comprise a plurality of transverse elements that are independent of one another in a practical sense but are joined together via flexible connecting struts and therefore can be produced together as a single part.

Figure 3:
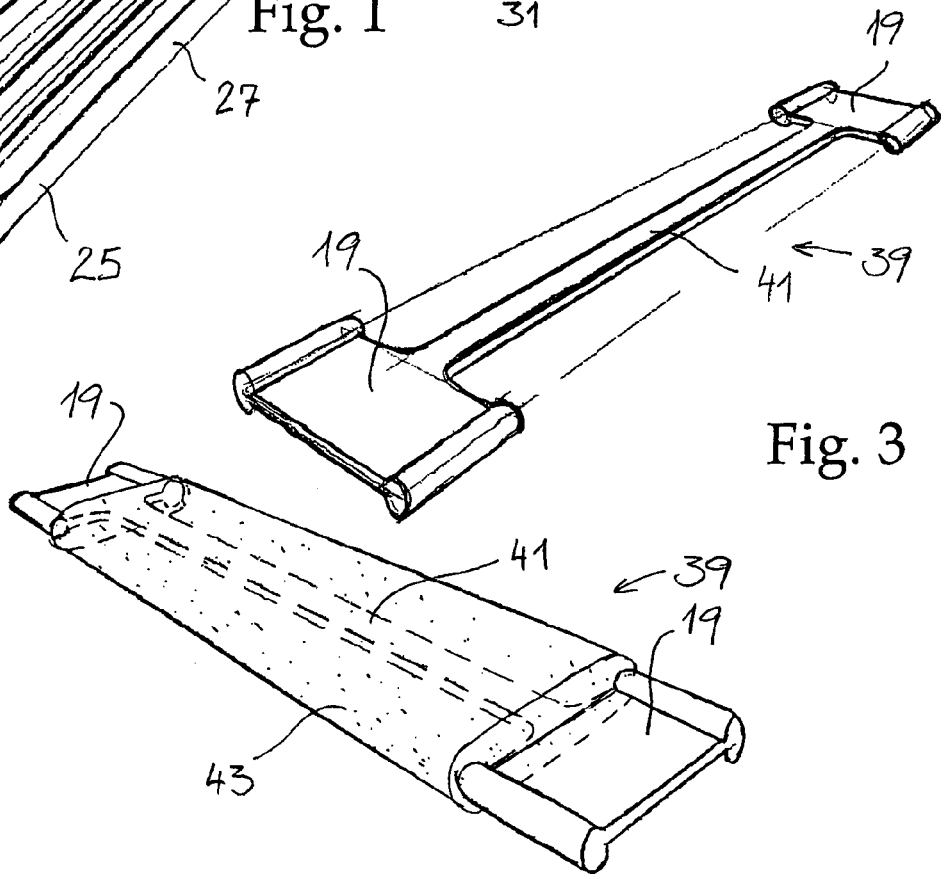
FIG. 3 shows a sketch in perspective of an unpadded and of a padded transverse element with integrated spacers.

In the exemplary embodiments of FIGS. 1-3 and 4-6, the self-adapting longitudinal structure 13 is embodied in two lateral frame parts. The spacers 19 are formed by short spacer structures, which are secured to the longitudinal structure 13 in such a way that they are tiltable relative to the compression element 17 and the tension element 15. Two short spacer structures are formed on spacer 19 and each are embodied on one rib 39 and are oriented axially to one another in FIGS. 1 through 3. The rib 39, with a strut 41, connects the spacer 19 to the longitudinal structure 13 on the left and to the longitudinal structure 13 on the right. The rib 39 is shown in FIG. 3, with and without a padding element 43 The padding element 43 envelops the strut 41 and elastically braces the middle region of the support face 21.

Figure 4:
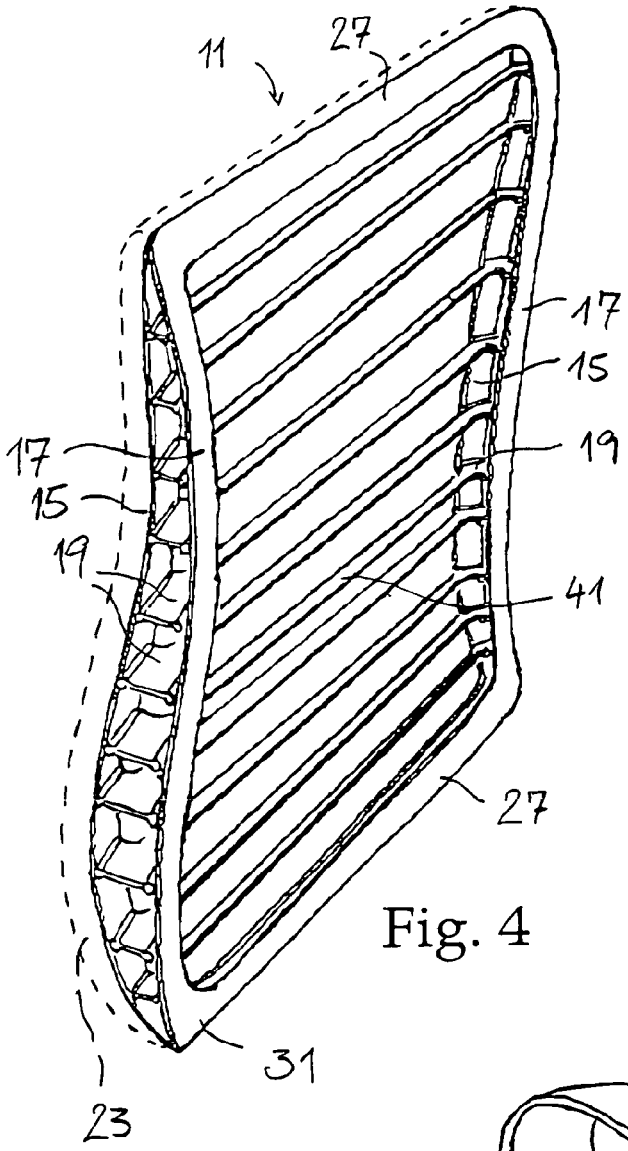
FIG. 4 shows a sketch in perspective of a backrest of the invention with angled transverse elements.
Figure 5:
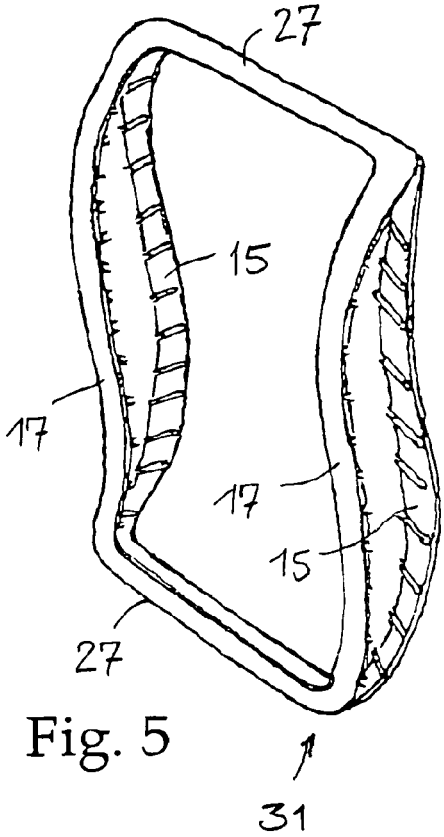
FIG. 5 shows a sketch in perspective of the backrest of FIG. 4, without its transverse elements and spacers.
Figure 6:
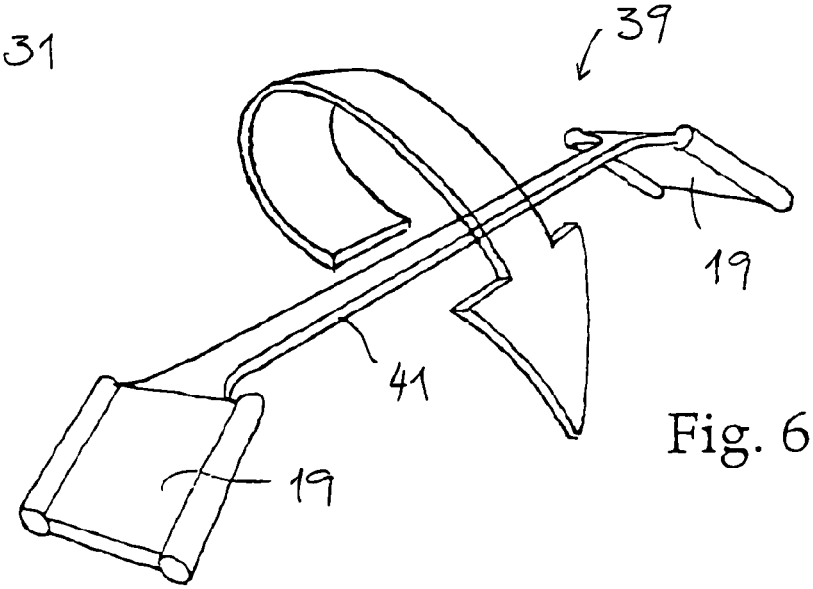
FIG. 6 shows a sketch in perspective of an unpadded transverse element with integrated spacers.

In FIGS. 4 through 6, the short spacer structures on the spacer 19 are not aligned axially to one another. The tilt axes of both short spacer structures, embodied on one rib 39, are oriented at an angle of approximately 120 to 140 degree. to one another. As a result, upon tilting of the spacers 19 as a consequence of a force pressing against the support face, the result is twisting of the rib 39 and in particular of the strut 41 of the rib 39. The force stored in the twisting can be utilized as a restoring force for the backrest 11. The twisting may be provided such that the backrest 11 is deformed in concave fashion in horizontal section.

Figure 7:
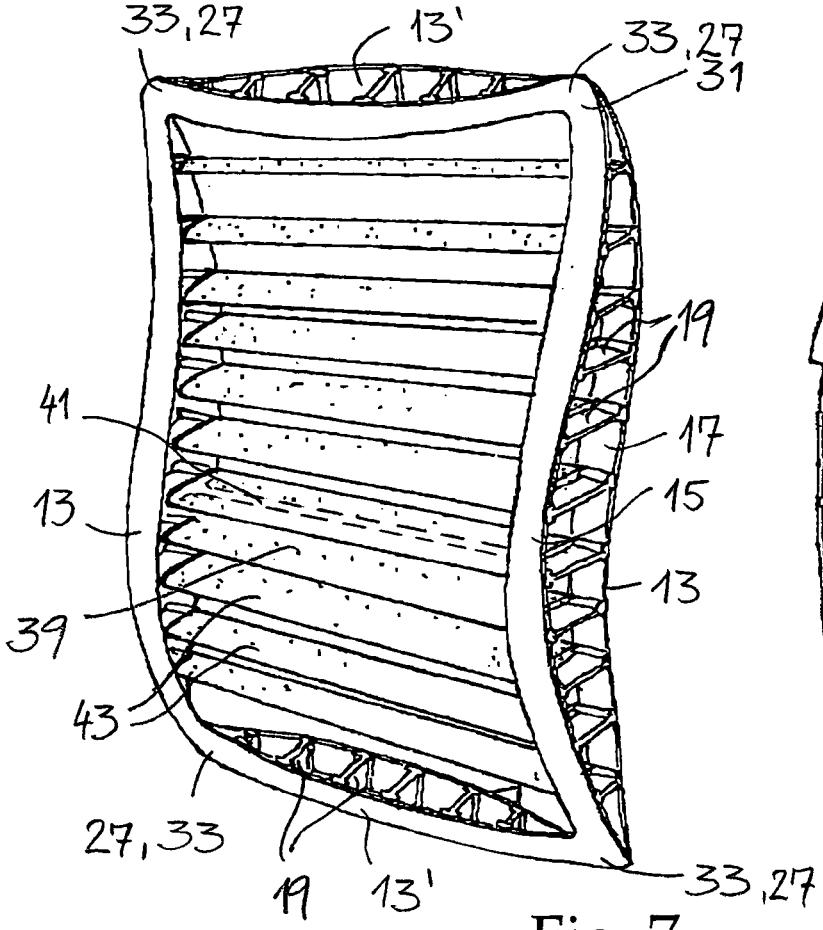
FIG. 7 shows a sketch in perspective of a backrest of the invention with transverse elements and, in addition to the lateral self-adapting longitudinal structures, also with self-adapting longitudinal structures located transversely.
Figure 9:
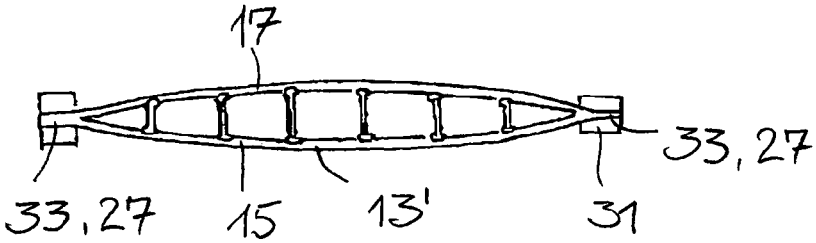
FIG. 9 shows a top view on the backrest of FIG. 7 or FIG. 8.
Figure 8:
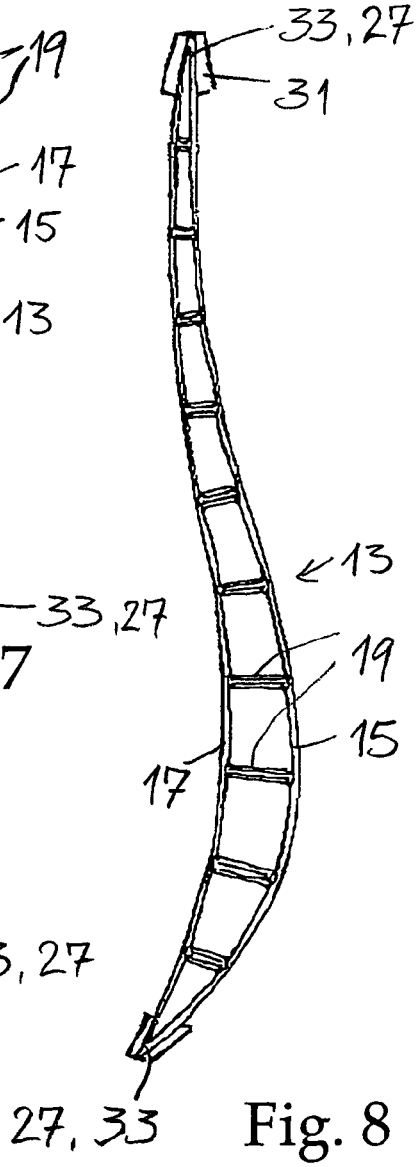
FIG. 8 shows a sketch of a side view of the backrest of FIG. 7.

In FIGS. 7 through 9, a backrest 11 is shown in which a self-adapting longitudinal structure 13 described is integrated both horizontally (13') and vertically (13) into one frame 31. Because the compression element 17 and the tension element 15 are joined together nondisplaceably in all directions at the corner points 33, both the horizontal and the vertical longitudinal structures 13', 13 can develop their kinematics regardless of the other longitudinal structure. The support face is an elastic fabric which is spread over the frame 31 and matches its motions in both directions. The backrest 11 may also be predeformed in concave fashion in the horizontal direction.

The frame 31 may, unlike what is shown in FIGS. 1 through 8, also be provided with spacers 19 all having the same width. At the fixation points 33, in this case in the corners, the compression element 17 and the tension element 15 can be located in spaced-apart fashion, as long as a displacement of the compression element and tension element 15, 17 counter to one another in the direction of the length of the structure 13 is prevented. Such a displacement can already be prevented by providing that the spacers 19 are located nondisplaceably and nonpivotably on the compression element 17 and the tension element 15.

The arrangement shown with two each of the short spacer structures on each spacer 19 and having one common rib 39 is not absolutely necessary.

Figure 11:
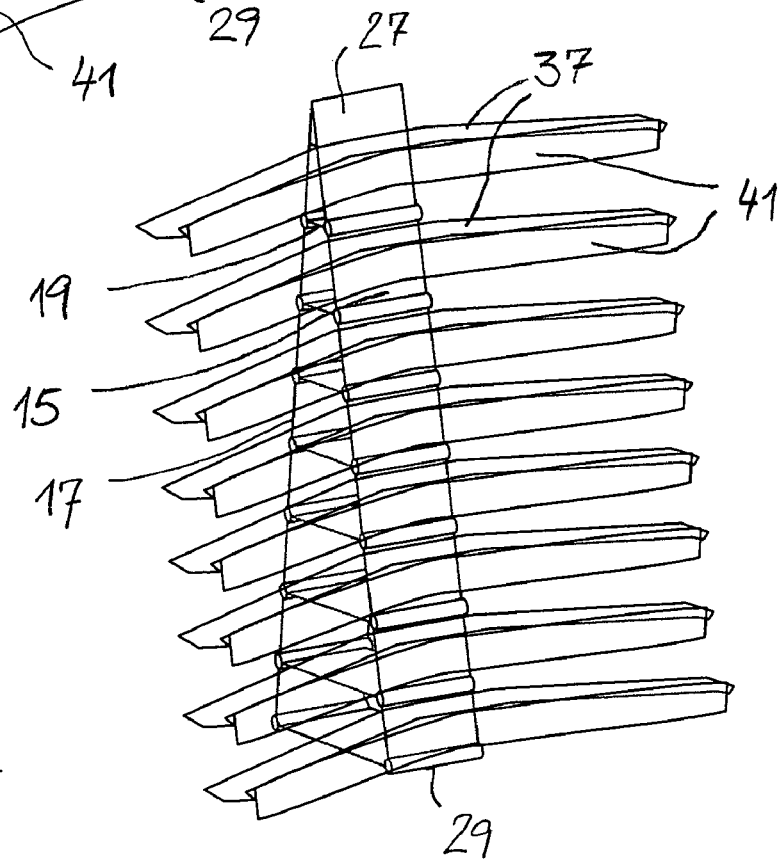
FIG. 11 shows a sketch in perspective of a backrest of the invention with a centrally located, triangular self-adapting longitudinal structure and with rib shaped members.
Figure 12:
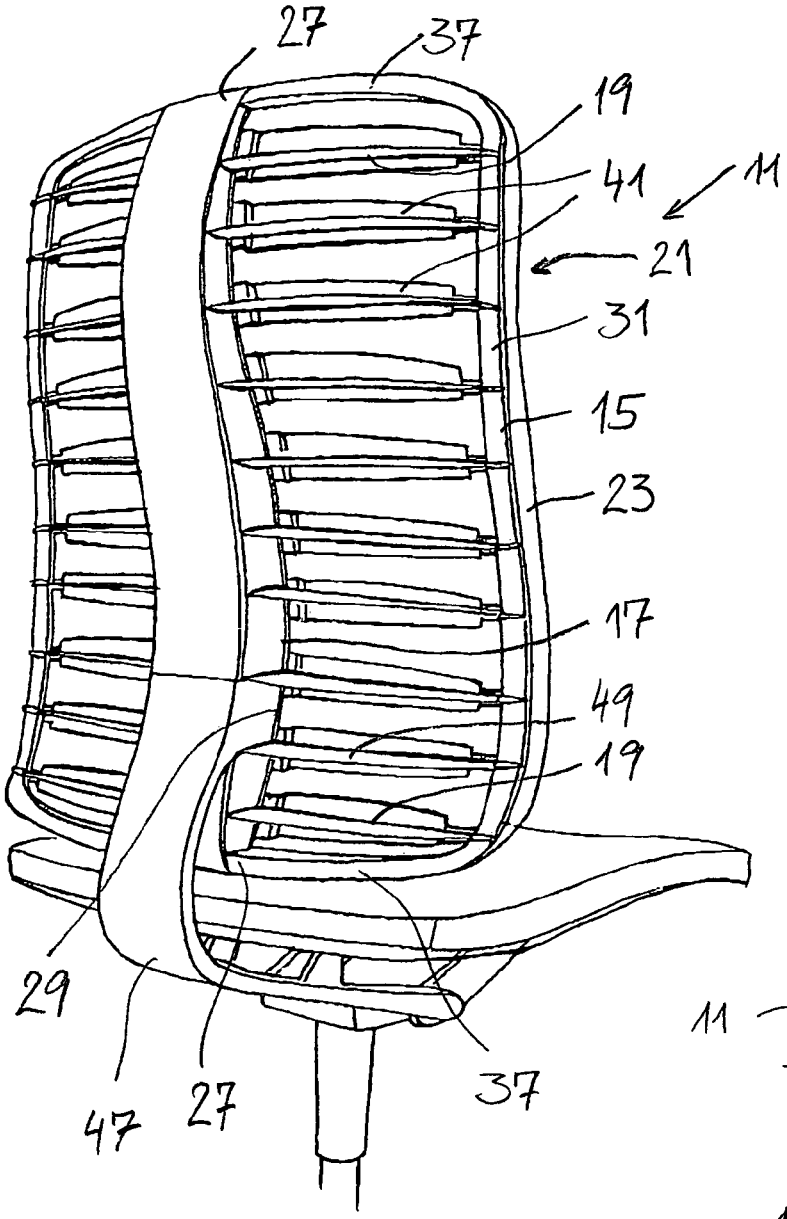
FIG. 12 shows a sketch in perspective of a backrest of the invention with two laterally located tension elements on the front and one central rear compression element, which are joined together via hoops.

In FIGS. 11 and 12, the self-adapting longitudinal structure 13 is formed by one or two triangular structures, which have a connection point 27 on only one end. In the connection point 27, the compression element 17 and the tension element 15 are joined together at a rigid angle.

The longitudinal structures 13 are joined together at a rigid angle at the top on the sharp end, and below, on the dull end, they have a support point 29, where they are firmly anchored. Between the support point 29 and the connection point 27, the compression element 17 and the tension element 15 are kept spaced apart from one another by means of spacers 19. The spacers 19 are formed by hoops which are pivotably connected to both the compression element and the tension element.

Figure 10:
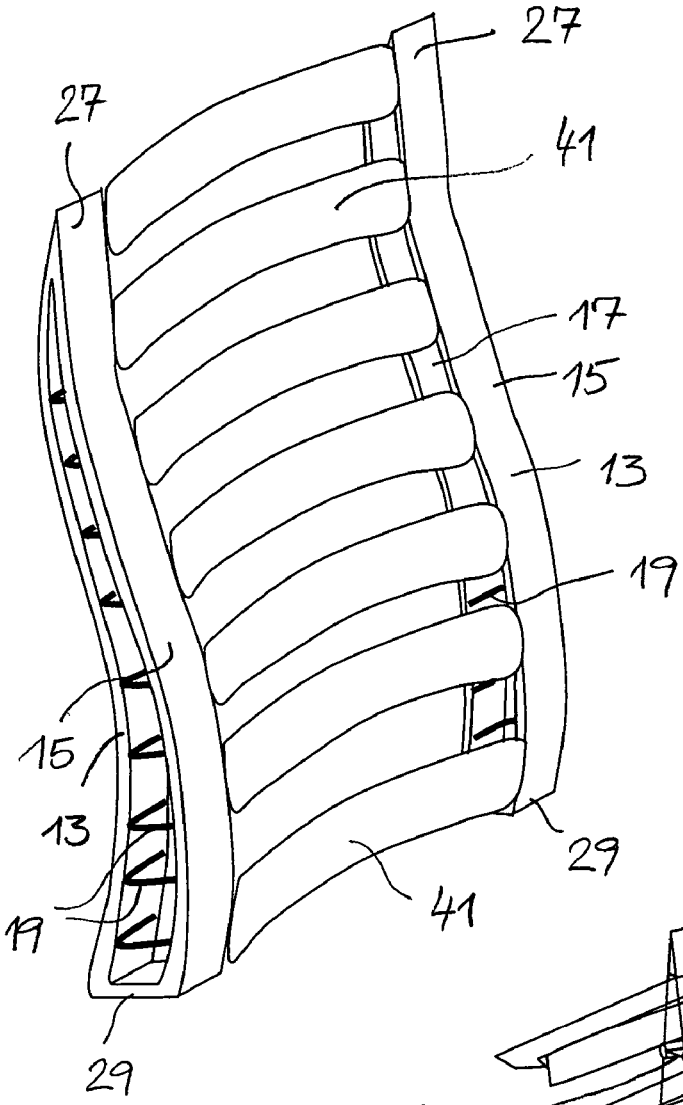
FIG. 10 shows a sketch in perspective of a backrest of the invention with two laterally located, triangular self-adapting longitudinal structures.

In FIG. 10, two such longitudinal structures 13 are located laterally. Between them, there are transverse elements 41, which are pivotably connected to the longitudinal structures 13.

In FIG. 11, only a single self-adapting longitudinal structure 13 is present. It is located centrally on an axis of symmetry of the support element 11. On the tension element 15 of the longitudinal structure 13, there are rib shaped members 37 which extend horizontally. Transverse elements 41 are pivotably connected to the ends of the rib shaped members 37 and support a pad, not shown, and extend transversely over the width of the support face and are curved slightly concavely.

The transverse elements 41 are shown in FIGS. 10 and 11 and are rotatably borne about pivot axes and which under load conform to the shape of the load being braced.

In the exemplary embodiments of FIGS. 12 through 18 as well, the transverse I elements 41 conform as a result of rotation.

Figure 13:
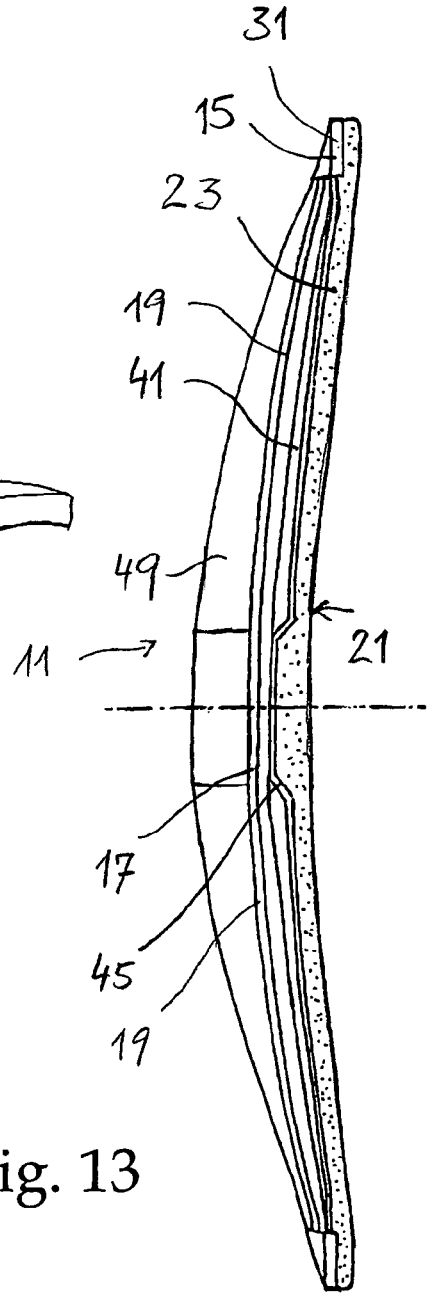
FIG. 13 shows a cross section through the backrest of FIG. 12.

In the exemplary embodiment of FIGS. 12 and 13, the transverse elements 41 are pivotably connected to a frame 31, and the frame 31 and transverse elements 41 ffri-4-1are covered with a thin pad 23. The transverse elements 41 are pivotably connected to the frame 31 and are pivoted by the load being braced in such a way that their support side is oriented perpendicular to the load. In the spinal region, the transverse elements 41 have a cutout 45, which is filled with the pad 23. As a result, thicker padding is assured for the vertebral processes of a spine leaning against it than for the person's back in the rib regions.

In this exemplary embodiment, the self-adapting longitudinal structure 13 is formed by one centrally located compression element 17 and two laterally located tension elements 15, and the spacers 19 extending parallel to the transverse elements 41. These spacers, in this exemplary embodiment, span not only the spacing from the rear and front longitudinal elements 17 and 15 perpendicular to the support face 21, but also the spacing parallel to the support face 21. The rear longitudinal elements 17, that is, the compression elements 17, also located laterally in FIGS. 1 through 9, are pushed together in FIGS. 12 and 13 into the middle between the two laterally located front longitudinal elements 15, or tension elements 15. Accordingly, the spacers 19 are extended in length and span practically half the width of the backrest. They are rotatably borne in the frame 31 and in the central rear longitudinal element 17, or are embodied merely as intrinsically twistable.

The frame 31 that forms the front tension element 15 is rigidly joined at two connection points 27 to the rear longitudinal element 17, which forms the compression element 17. The rear longitudinal element 17 is located on a support 47 at the support point 29.

The horizontal wings 49, which follow the spacers 19 and are shown in FIGS. 12 and 13, are purely decorative. These wings 49 twist visibly when a load is put on the backrest of the chair and therefore make the self-adapting function of the backrest 11 visible. The thickness of the rear longitudinal element likewise serves this purpose of illustrating the function. However, this thickness must not impair the mobility of the rear longitudinal element 17.

Figure 14:
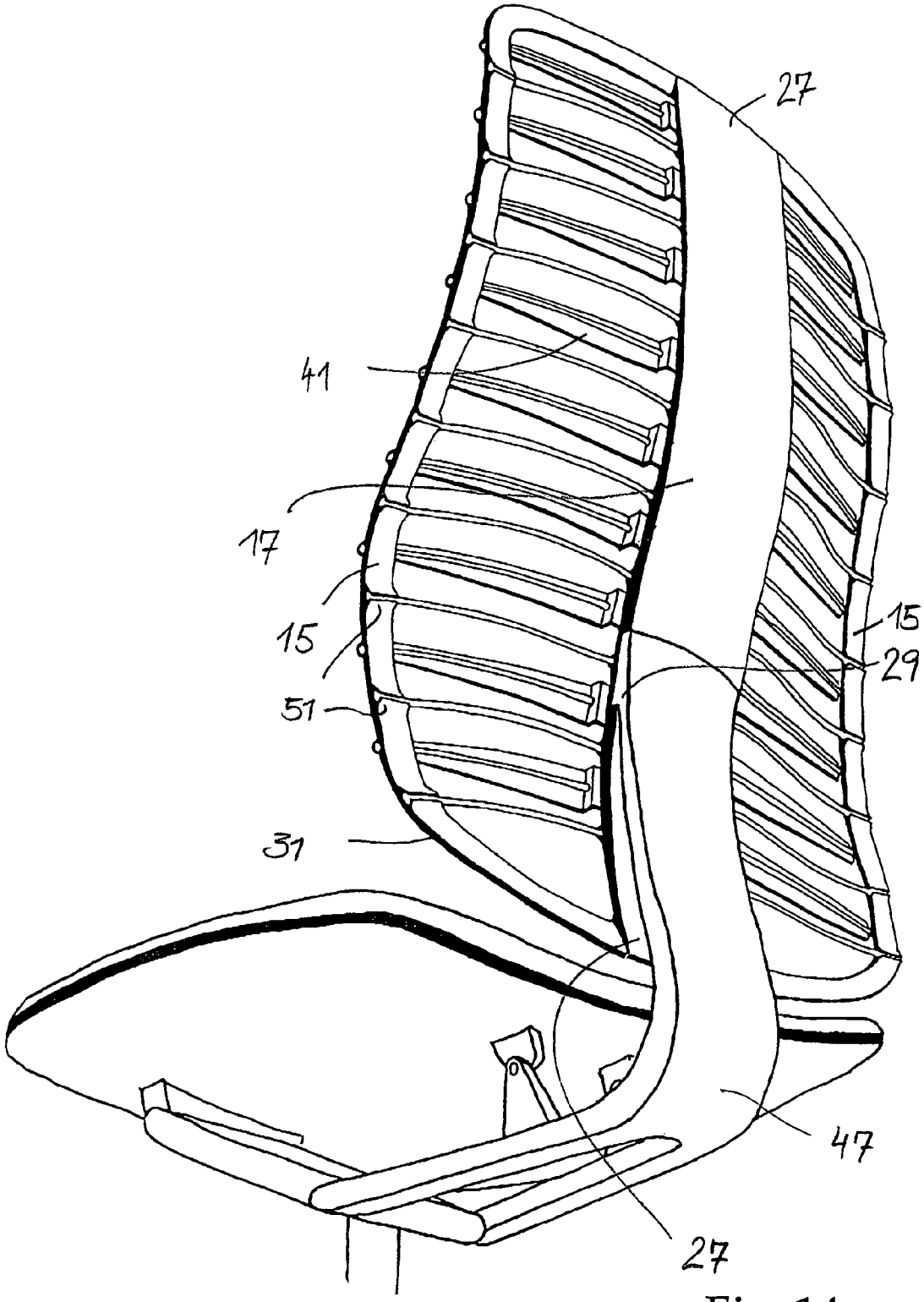
FIG. 14 shows a sketch in perspective of a chair with a backrest of the invention with two laterally located tension elements on the front and one central rear compression element, which are joined together via hoops.
Figure 15:
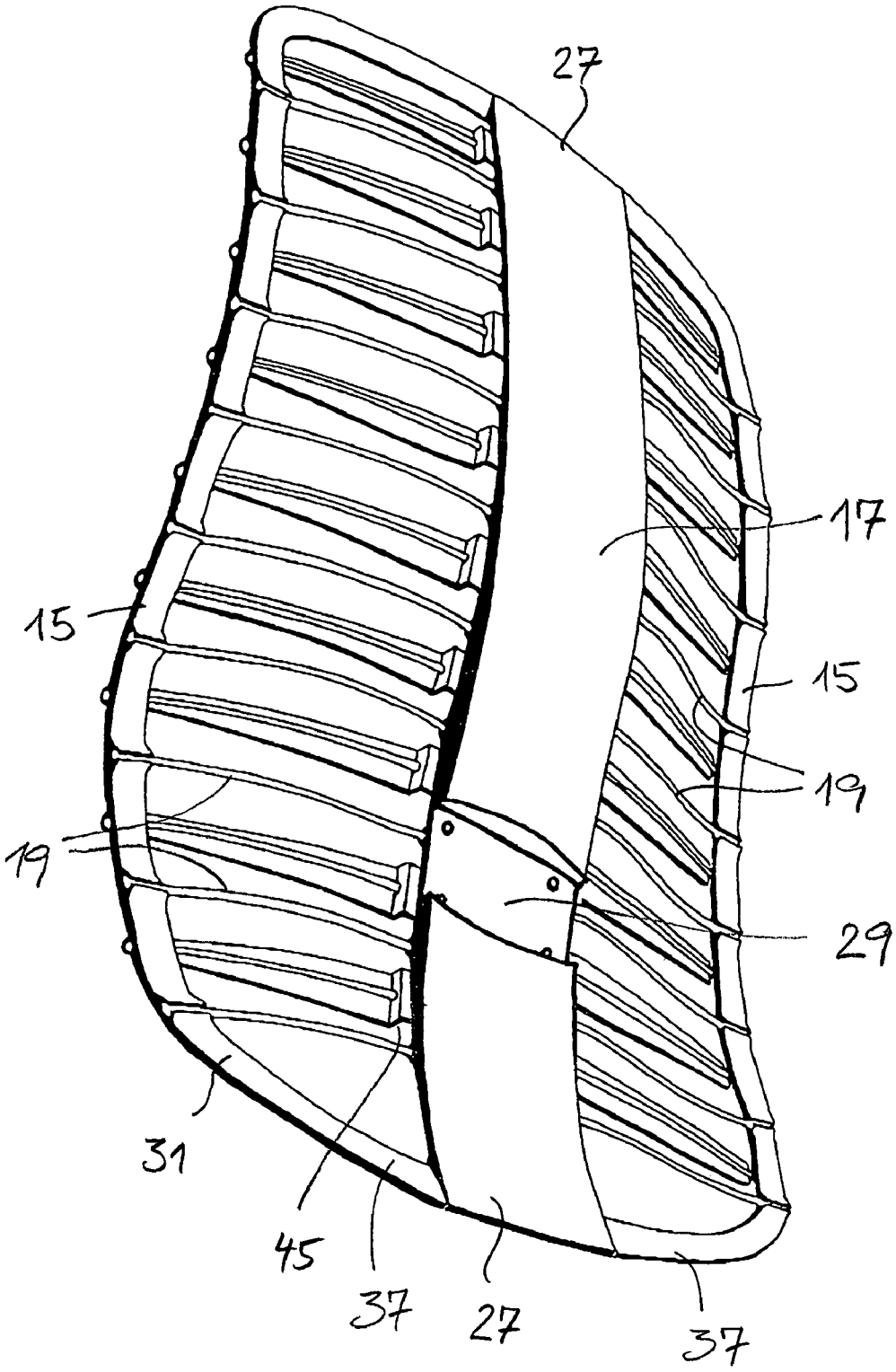
FIG. 15 shows a backrest of the chair of FIG. 14.

In FIGS. 14 and 15, the backrest 11 is embodied without these illustrative parts and is therefore slenderer. The central rear longitudinal element 17, which takes on the function of the compression element 17, is secured in its lower half to a support 47. The support point 29 where the bracing of the backrest 11 by the support 47 takes place can be seen in FIG. 15. The frame 31 forms on tension element 15 each on the left and on the right. These two tension elements 15 are joined to the compression element 17 via the spacers 19 and via rib shaped members 37. The spacers are simply snapped into the frame 31 in the region of the front longitudinal elements 15 and into the central rear longitudinal element 17. The spacers 19 are curved wire elements, which can be snapped on their ends into cylindrical receptacles 51 on the frame 31. The spacers 19 are pivotably connected to the back side of the backrest 11.

The rib shaped members 37, together with the tension elements 15, form a frame 31 and to some extent join the tension elements 15 to the compression element 17 at a rigid angle.

On the front of the backrest 11, the transverse elements 41 or laminations 41 are snapped into the lateral longitudinal elements 15. They are borne rotatably in them about horizontal axes, so that they conform to a load leaning against them. The transverse elements also have a central recess 45, which again makes it possible to provide a greater padding thickness in the region of the spinal column.

Figure 16:
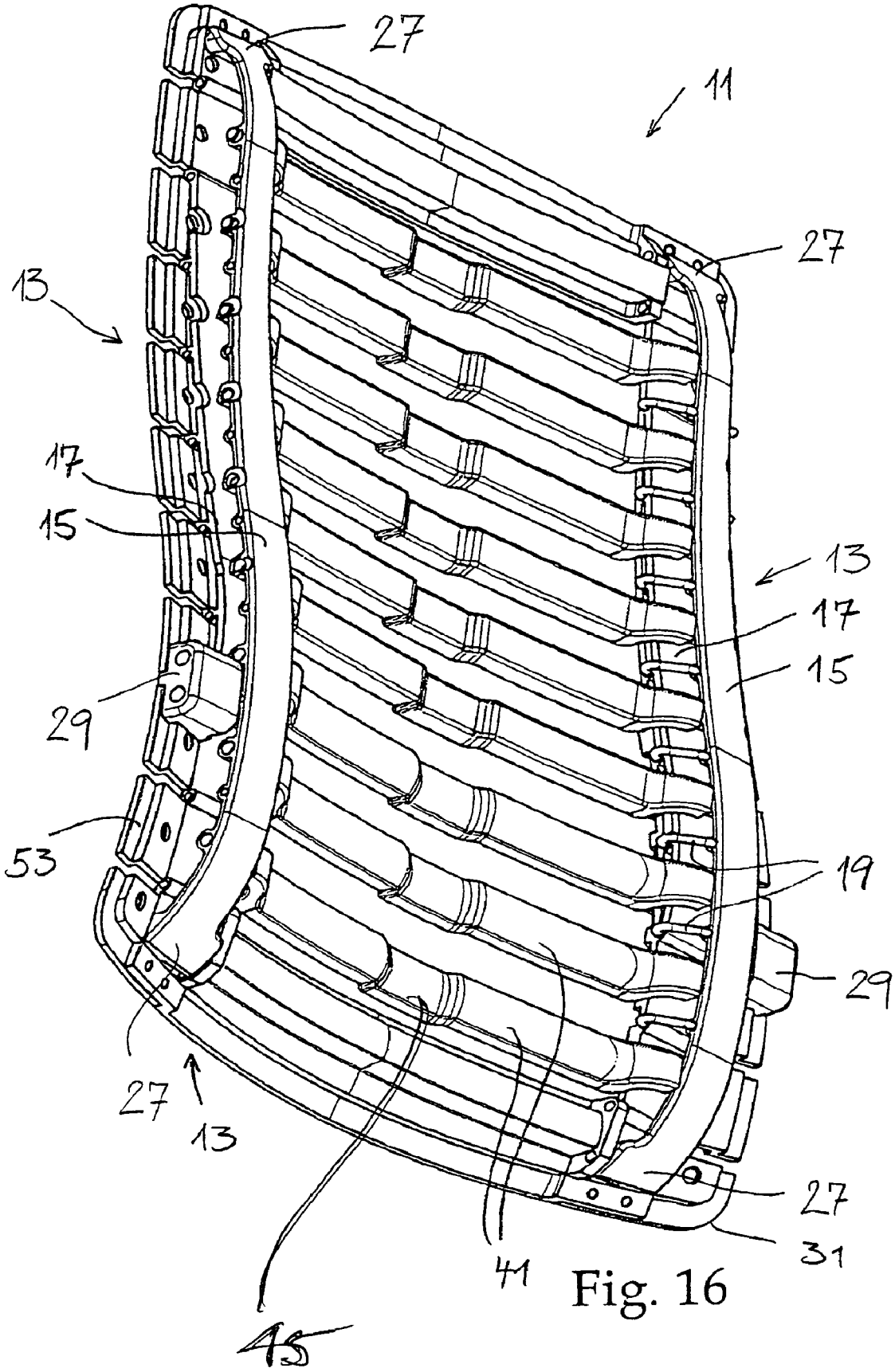
FIG. 16 shows a perspective view of a skeleton of a backrest of the invention, with two laterally located self-adapting longitudinal structures, and self-aligning transverse elements between them.
Figure 17:
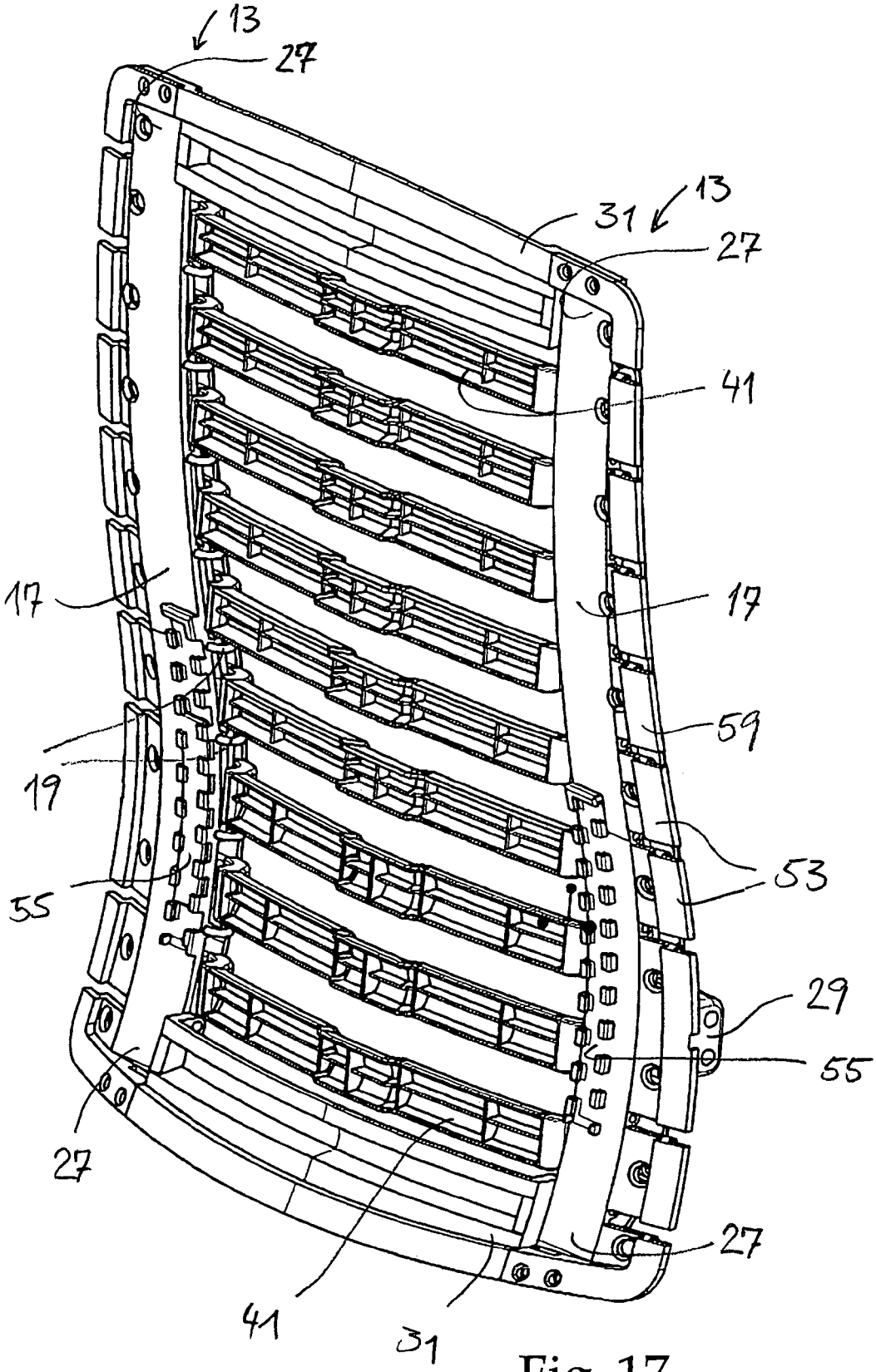
FIG. 17 shows the skeleton of FIG. 16, but from the diametrically opposed back side.
Figure 18:
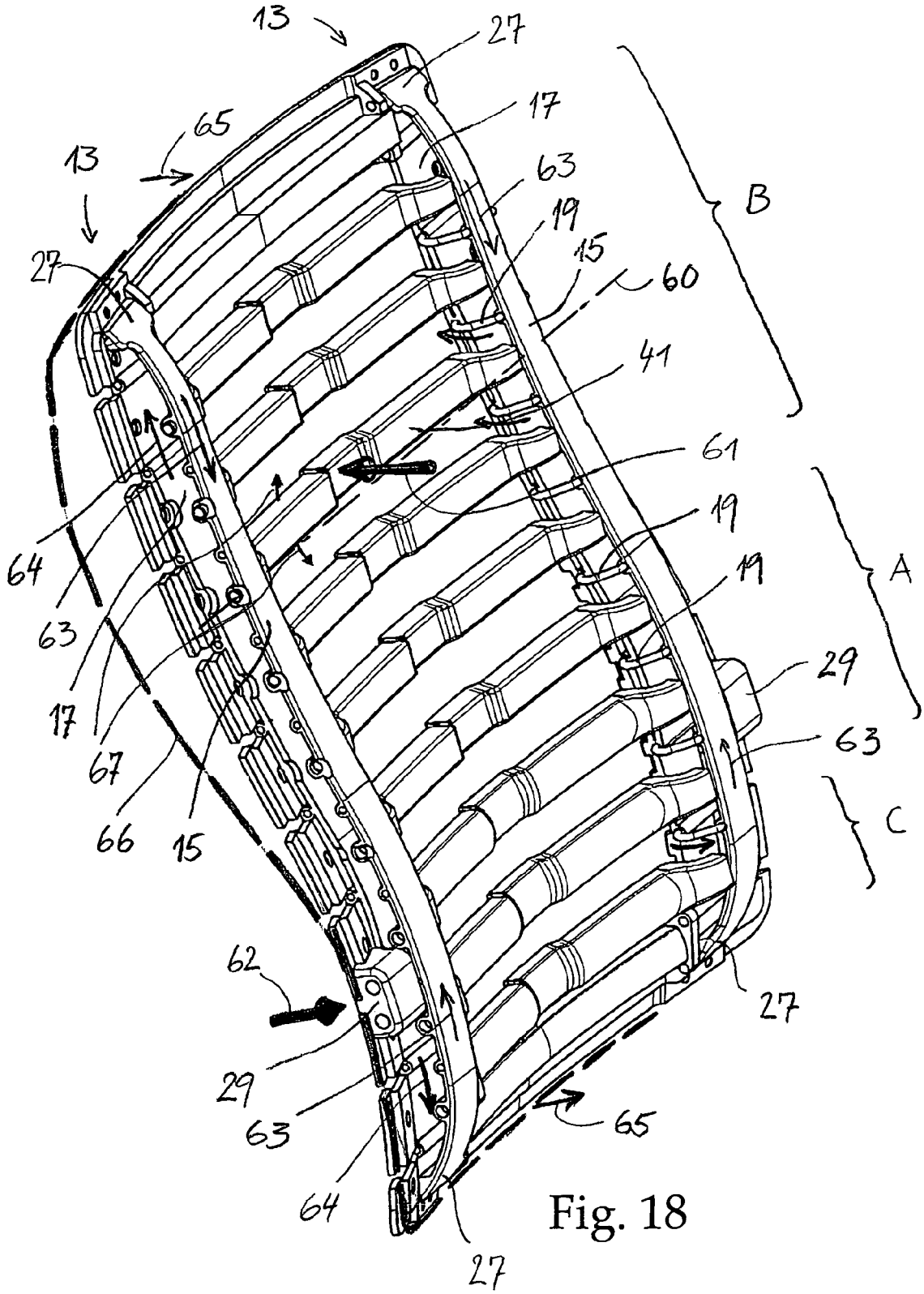
FIG. 18 shows the skeleton of FIGS. 16 and 17 in a further view to explain the self-adapting function.

In the exemplary embodiment of FIGS. 16 through 18, the skeleton shaped structure of the backrest essentially comprises two laterally located longitudinal structures 13 and transverse elements located between them. The longitudinal structures 13 each have one support point 29 and are joined together at the top and bottom to form a frame 31. They have a front longitudinal element, the tension element 15, and a rear longitudinal element, the compression element 17, which are joined together movably via spacers 19 and at a rigid angle at two terminal connection points 27. The spacers 19 are embodied as hoops and are pivotably anchored in the front and rear longitudinal elements 15, 17 of a longitudinal structure 13.

The transverse elements 41 are furthermore pivotably anchored in the front longitudinal element 15. These transverse elements 41 are embodied as curved rearward, so that a support face of the transverse elements 41 is located behind the axis about which they are pivotable relative to the longitudinal structure 13.

These transverse elements 41 likewise have a recess 45, which offers space for a special padding for the spinal column.

There are three different types of transverse elements here: In the uppermost three transverse elements, the support faces are shaped as slightly concave in vertical section; the middle three transverse elements are embodied as flat in vertical section; and the lower three transverse elements are shaped as slightly convex in vertical section. These shapings correspond to the general shape of the back support in these three regions. As a result, the bracing of the padding by the transverse elements 41 is done over as large an area as possible and as uniformly as possible.

The rear longitudinal elements 17 are embodied in two layers, or plies. Between the two layers, the pivotable connection points for the spacers 19 are embodied. The two-ply nature serves to stiffen the rear longitudinal elements 17. Eyelets 53, which are equipped to carry a rear lining, are embodied on the rear layer. On the back side of the rear layer, there is also a pocket 55, into which reinforcing strips can be inserted, in order to enable adjusting the flexibility or stiffness of the longitudinal structure 13 in the region of the support point.

In FIG. 18, the mode of operation of this kind of self-adapting support element 11 is shown in terms of the exemplary embodiment of FIGS. 16 and 17.

In FIG. 18, an increased load on the third transverse element from the top is assumed. This transverse element is pressed to the rear by the load (arrow 61).

The load (arrow 61) is transferred by the transverse element 41, via the tension elements 15, to the spacers 19, the compression elements 17, and finally the support point 29 (arrow 62) and the support (such as 47) that supports the support point.

The load causes the upper part of the backrest to seek to bend rearward about the support point 29. The tension element 15 therefore exerts a tension on the lower connection point 27, and simultaneously naturally also a tension on the upper connection point 27 (arrows 63). The compression element 17 therefore exerts a pressure on the upper and lower connection points 27 (arrows 64). As a consequence, the upper and lower connection points 27 move forward (arrows 65). The backrest 11 deforms in accordance with the line 66. The upper connection point is therefore pivoted to the rear as a consequence of the deformation that takes place adjacent to the support point 29, and forward as a consequence of the deformation that occurs in the region of the action of the load. The upper end of the backrest 11 therefore moves only slightly to the rear, less than the region having the transverse element 41, and also slightly toward the support point 29. The backrest experiences such a deformation until such time as the forces that act on the backrest 11 are in equilibrium.

The transverse element 41 is pivotably tied (axis 60) to the tension elements 15. The transverse element 41 rotates under load at the pivotable connection points to a position into which it rests as flatly as possible against the person's back forming the load and in the process is oriented in the direction of the arrows 67.

From this schematic explanation, it can be seen that the adaptation takes place automatically, and the backrest 11 arches in convex fashion under load about the support point 29 in the lordosis area A, adapts concavely to the spinal column in the thoracic spine region B, and supports the pelvis C in the pelvic region. It can even be observed that the lordosis curvature adjusts farther upward or farther downward, depending on the length of the person's back being supported.

The invention claimed is:

1. A support element having a support face forming a front side of the support element, said element comprising:

a self-adapting longitudinal structure, including:

at least one front, first longitudinal element and at least one rear, second longitudinal element, extending substantially parallel to the first longitudinal element, which second longitudinal element is connected at a rigid angle to the first longitudinal element at at least one connection point, and is borne at a support point spaced apart from the connection point, and as a plurality of spacers, which between the connection point and the support point keep the second longitudinal element spaced apart from the first longitudinal element, and which spacers are each connected elastically or pivotably to the first longitudinal element and elastically or pivotably to the second longitudinal element, bearer means, having two elongated peripheral parts which extend in the same direction as the longitudinal elements or a plurality of rib shaped members, are braced against the self-adapting longitudinal structure in such a way that the bearer means adapts motions of the self-adapting longitudinal structure; and at least one transverse element, which forms or braces the support face and extends transversely over the width of the support element and is secured to the bearer means.

2. The support element in accordance with claim 1, characterized in that the second longitudinal element is embodied in two layers.

3. The support element in accordance with claim 1, characterized in that the transverse elements are separate from the spacers.

4. The support element in accordance with claim 3, characterized in that the spacers are hoops, which are connected in hinged fashion to the first and second longitudinal elements.

5. The support element in accordance with claim 1, characterized in that the transverse elements are pivotably connected to the first longitudinal elements or to rib shaped members connected to the first longitudinal element.

6. The support element in accordance with claim 1, characterized in that the pivot axis of a pivotable connection between the transverse elements and the first longitudinal elements, or the rib shaped members connected to the first longitudinal element, is approximately perpendicular to the longitudinal orientation of the longitudinal elements.

7. The support element in accordance with claim 1, wherein a pivot axis of a pivotable connection between the transverse elements and the first longitudinal elements, or the rib shaped members connected to the first longitudinal element, is located in front of a support structure formed by the transverse elements.

8. The support element in accordance with claim 1, characterized in that said at least one transverse element is shaped in a way adapted to the shape of the body that is to be supported.

9. The support element in accordance with claim 1, characterized in that the longitudinal elements are shaped in a way adapted to a shape of the body that is to be supported.

10. The support element in accordance with claim 1, characterized in that a support or a support point for a support is embodied on the second longitudinal element.

11. The support element in accordance with claim 1, characterized in that the second longitudinal element is embodied more rigidly than the first longitudinal element.

12. The support element in accordance with claim 1, characterized in that the second longitudinal element is located centrally between two first longitudinal elements.

13. The support element in accordance with claim 1, characterized in that at least two rear longitudinal elements are present, which are each embodied in the immediate vicinity of said at least one front, first longitudinal element.

14. The support element in accordance with claim 1, characterized in that the second longitudinal element is connected at a rigid angle to the first longitudinal element at two connection points that are spaced apart from one another in the longitudinal direction of the support element.

15. The support element in accordance with claim 14, characterized in that the transverse elements are separate from the spacers.

16. The support element in accordance with claim 14, characterized in that the spacers are hoops, which are connected in hinged fashion to the first and second longitudinal elements.

17. The support element in accordance with claim 14, characterized in that a support point is embodied between the two connection points.

18. The support element in accordance with claim 17, characterized in that at the support point, a support that carries the support element, is located nonpivotably on the second longitudinal element.

19. The support element in accordance with claim 17, characterized in that the support point is embodied on one side of a center between the two connection points.

20. The support element in accordance with claim 19, characterized in that at the support point, a support that carries the support element, is located nonpivotably on the second longitudinal element.

* * * * *